US007094104B1

(12) United States Patent
Burke et al.

(10) Patent No.: US 7,094,104 B1
(45) Date of Patent: Aug. 22, 2006

(54) IN-LINE COAXIAL CIRCUIT ASSEMBLY

(75) Inventors: Rodger Burke, Naperville, IL (US); Kendrick Van Swearingen, Woodridge, IL (US); Joon Lee, Bolingbrook, IL (US); Howard Davis, Clarendon Hills, IL (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/908,253

(22) Filed: May 4, 2005

(51) Int. Cl.
*H01R 13/66* (2006.01)
*H01R 12/00* (2006.01)

(52) U.S. Cl. ..... 439/620; 439/76.1

(58) Field of Classification Search ..... 439/63, 439/76.5, 620; 333/175, 185
See application file for complete search history.

(56) References Cited

U.S. PATENT DOCUMENTS 3,320,557 A * 5/1967 Garstang ..... 333/182
3,750,053 A 7/1973 LeDonne
4,187,481 A * 2/1980 Boutros ..... 333/182
4,262,317 A 4/1981 Baumbach
4,359,764 A 11/1982 Block
4,554,608 A 11/1985 Block
5,060,108 A * 10/1991 Baker et al. ..... 361/283.4
5,278,525 A * 1/1994 Palinkas ..... 333/175
5,329,262 A * 7/1994 Fisher, Jr. ..... 333/33
5,953,195 A 9/1999 Pagliuca
5,982,602 A 11/1999 Tellas et al.
6,236,551 B1 5/2001 Jones et al.
6,294,740 B1 9/2001 Van Swearingen
6,452,773 B1 9/2002 Aleksa et al.
6,529,357 B1 3/2003 Landinger et al.
6,636,407 B1 10/2003 Ryman
6,636,408 B1 10/2003 Pagliuca
6,688,916 B1 2/2004 Lee
6,721,155 B1 4/2004 Ryman
6,785,110 B1 8/2004 Bartel et al.

* cited by examiner

*Primary Examiner*—James R. Harvey
(74) *Attorney, Agent, or Firm*—Babcook IP, LLC

(57) ABSTRACT

An in-line coaxial circuit assembly having a first portion with a first electrical connector interface on a first end and a second portion having a second electrical connector interface on a second end. The first portion and the second portion adapted to couple together along an outer wall of at least one of the first portion and the second portion. A cylindrical outer conductor section coaxial with the outer wall may be formed in at least one of the portions. The coupling of the first portion and the second portion forms an enclosed cylindrical PCB chamber between the outer conductor section and inner conductor or outer wall, if present. A PCB may be positioned within the PCB chamber, the PCB coupled to the inner conductor through a slot in the outer conductor section, if present.

17 Claims, 4 Drawing Sheets

IN-LINE COAXIAL CIRCUIT ASSEMBLY

BACKGROUND

Electrical circuits such as filters, surge suppression, DC bias injection and or monitoring assemblies of various configurations have been adapted into modular assemblies for easy insertion in-line with coaxial transmission lines. Typically, a housing having a desired coaxial connector interface at either end is formed with a chamber adapted to receive a printed circuit board (PCB) with the required components and interconnecting circuitry. To minimize the opportunity for moisture infiltration, electrical interference and or vibration failure the PCB chamber is fully enclosed and environmentally sealed within the housing.

To minimize the degradation of signals in the transmission line from impedance discontinuities, the assembly typically has a pass through section along a longitudinal axis with center and outer conductor dimensions and spacing similar to those of the expected coaxial transmission line the housing is designed to be used with. Therefore, the PCB chamber has typically been formed as an off-axis extension of the housing in the form of a generally rectangular milled or cast cavity of the surrounding housing. Because the PCB chamber cavity(s) are off-axis, with respect to the pass through section, forming the prior housing requires separate axis specific housing re-mounting steps to complete milling operations during manufacture, significantly increasing the cost of the resulting assembly.

In-line coaxial assemblies with a cylindrical central cavity, formed coaxial with the pass through section have been used to enclose spiral inductor surge suppressor elements that couple the inner conductor to the outer conductor, without a PCB. However, the central cylindrical inner cavity presents a significant impedance discontinuity with respect to the dimensions of the associated coaxial cable and the lack of a PCB prevents the use of more complex electrical circuits.

The increasing competition for in-line RF assemblies has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
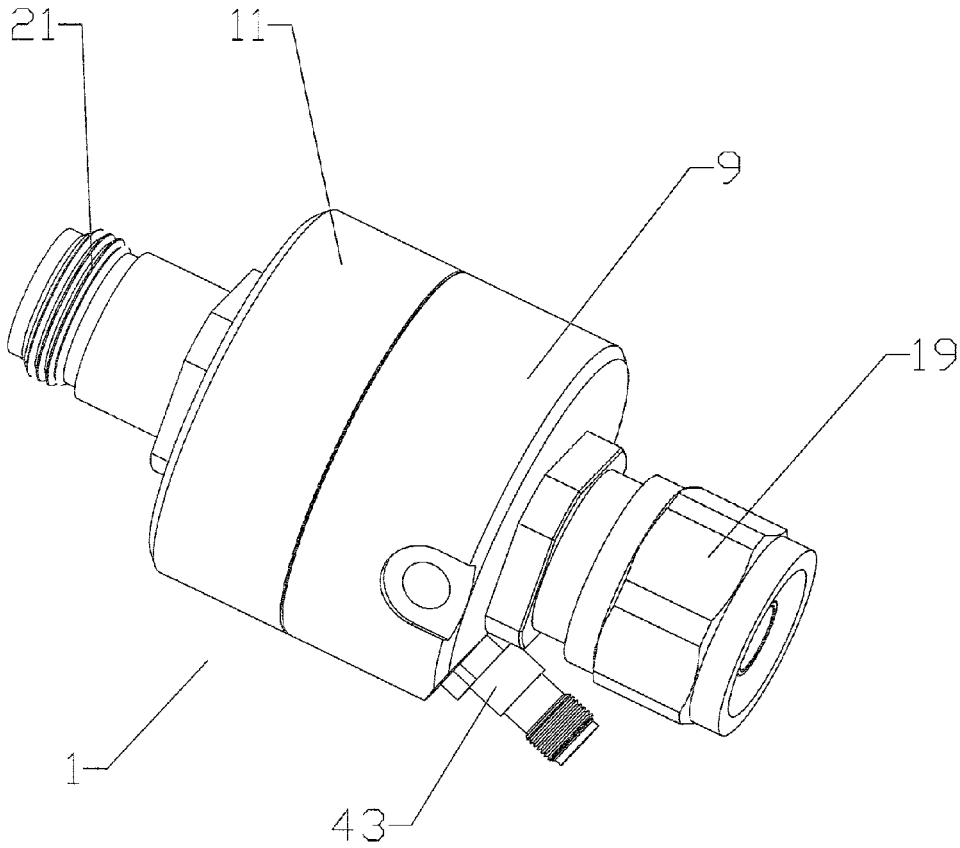
FIG. 1 is a schematic isometric external view of an exemplary embodiment of the invention, a coaxial ring circuit assembly in the form of an in-line DC Bias injector and surge suppressor.

As shown in FIGS. 1–4, a coaxial ring circuit assembly 1 according to an exemplary embodiment of the invention has a printed circuit board (PCB) 3 positioned in a perpendicular (normal) orientation with respect to a longitudinal axis of the assembly 1. The PCB 3 is seated within an enclosed cylindrical PCB chamber 5 surrounding an outer conductor sleeve 7 section.

The assembly 1 is composed of a first portion 9 and a second portion 111 adapted to couple together, for example via thread(s) 13 formed in corresponding overlapping sections of an outer wall 15 of each portion. A sealing gasket such as an o-ring 17 may be applied between the overlapping section(s) to environmentally seal the assembly 1. Alternatively, the first and second portion(s) 9,11 may be adapted for permanent interconnection via a friction fit between the overlapping sections of the outer wall 15.

The outer conductor sleeve 7 section(s) extend generally between a first connection interface 19 of the first portion 9 and a second connection interface 21 of the second portion 11. A diameter along the outer conductor sleeve 7 section(s) may be selected to seat insulator(s) 23 and or minimize an impedance discontinuity that may occur between the assembly 1 and upstream and or downstream coaxial cable that the assembly 1 will be coupled in-line with. The respective outer conductor sleeve 7 section(s) of the first and second portion(s) 9, 11 may be adapted to bottom against each other in secure electrical connection as the thread(s) 13 or other retaining arrangement formed along the outer wall(s) 15 are fully engaged.

The first portion 9 and second portion 11 also each support an inner conductor 25 positioned coaxially within the outer conductor sleeve 7 section by one or more insulator(s) 23. The inner conductor 25 of each portion is adapted to mate together as the first and second portion(s) 9, 11 are coupled, for example via a pin 27 into spring finger 29 configuration. Where direct current isolation is desired, such as DC bias injection for upstream circuits and or surge protection for downstream circuits, a dielectric spacer such as a dielectric sleeve 31 may be installed between the pin 27 and spring finger(s) 29 or other connection between the inner conductor 25 of each portion. The dielectric spacer may be alternatively formed as an air gap, dielectric coating or the like which provides a direct current break in the inner conductor 25 but capacitively couples higher frequencies via a capacitive coupling configurable via the thickness and or dielectric properties of the selected dielectric material. In alternative embodiments, the dielectric spacer or other form of DC break may be omitted and or permanently formed in the inner conductor so that a single inner conductor 25 element extends between the first connection interface 19 and the second connection interface 21.

Electrical connection between the PCB 3 and the inner conductor 25 is via at least one slot 33 formed in the outer conductor sleeve 7 section of the first and or second portion 9, 11. A coupling conductor 35, for example one leg of an inductor, passes from the PCB 3, through the slot 33 and is coupled to the inner conductor 25 for example via a butt solder joint and or insertion into a corresponding hole 35 formed in the inner conductor 25. The PCB 3 may be formed with contact surface(s) 37, for example about connection hole(s) 39, for coupling with the outer conductor and or a grounding connection about the bottom of the PCB chamber 5. To secure the PCB 3 within the PCB 3 chamber, connector(s) such as screw(s) 41 may applied through the connection hole(s) 39. Alternatively and or additionally, the PCB 3 may be coupled with one or more inputs and or output port(s) 43 formed in the first and or second portion(s) 9, 11. The port(s) 43 may be used, for example, to supply a DC bias current to the PCB 3 or as a signal tap output. To avoid interfering with the associated connection interface, the port(s) 43 may be arranged at an angle with respect to the longitudinal axis of the assembly 1.

Figure 2:
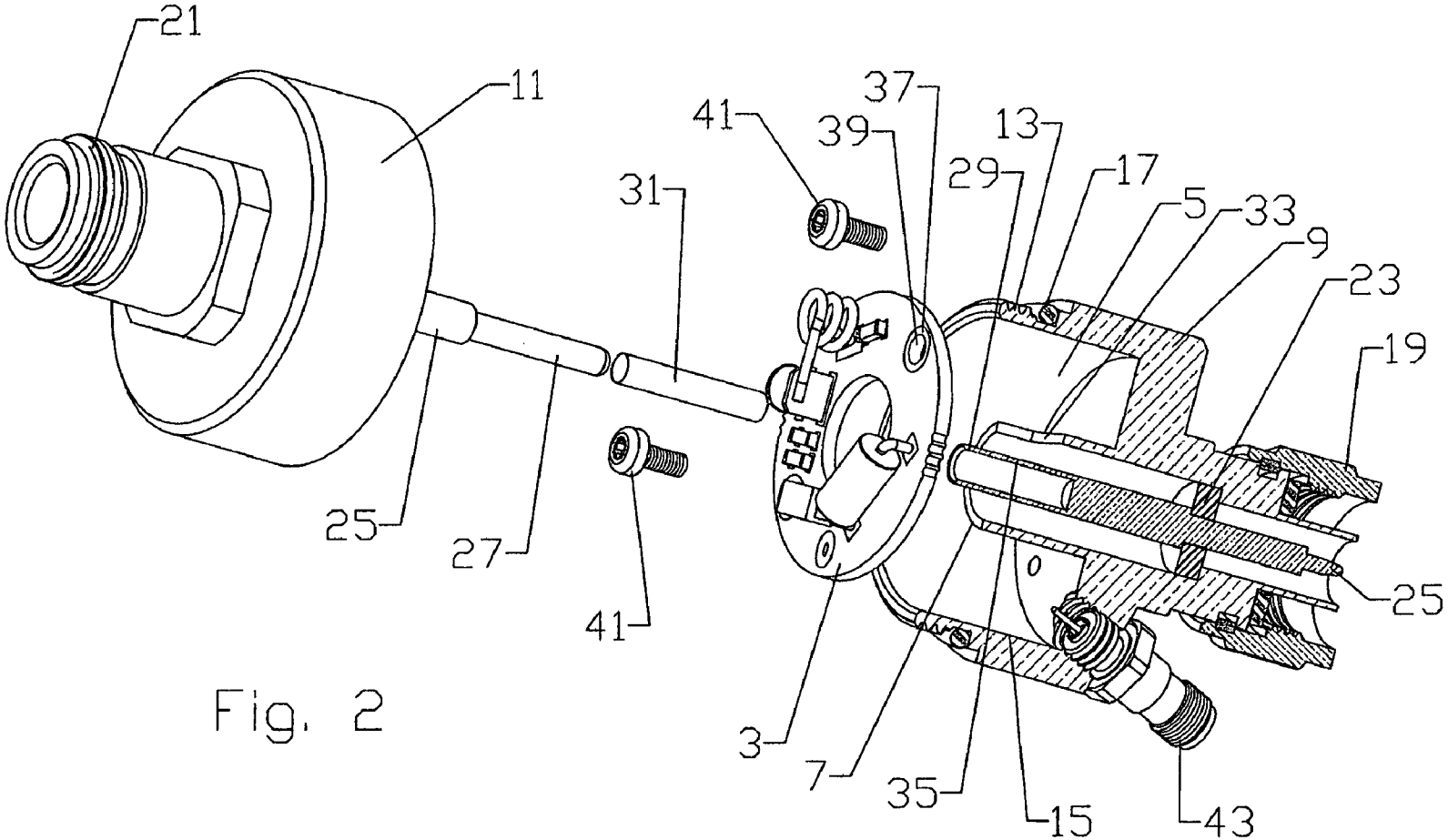
FIG. 2 is a schematic isometric exploded view of FIG. 1, the second portion shown in cross-section for clarity.
Figure 3:
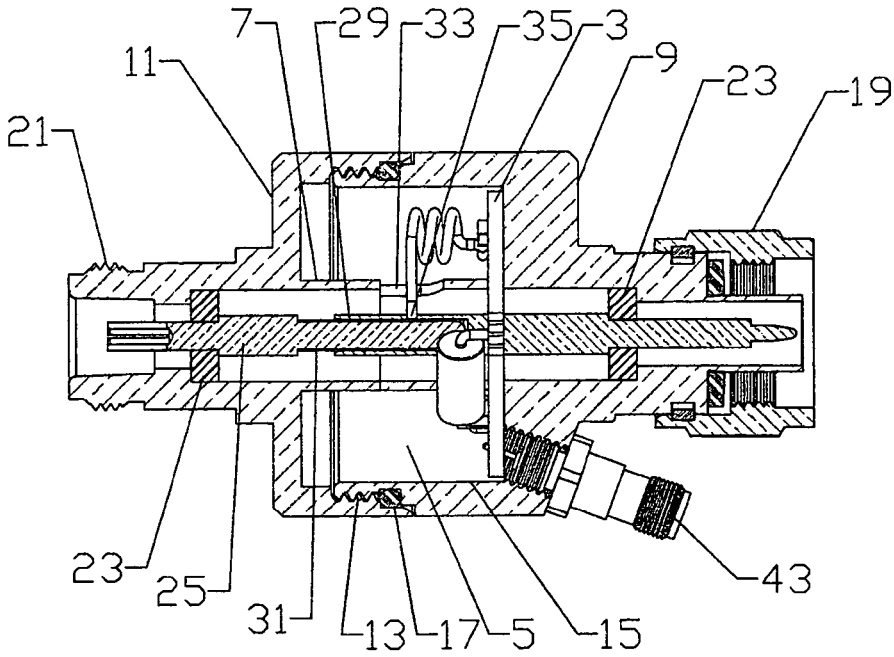
FIG. 3 is a schematic side cross-section view of the assembly of FIG. 1, the PCB and electrical components thereon shown in side view for clarity.
Figure 4:
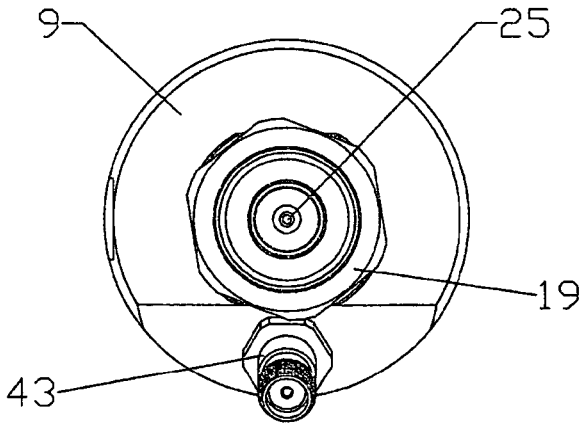
FIG. 4 is a schematic end view of the second portion of FIG. 1.

As shown in FIG. 2, the PCB 3 may be formed in a ring configuration. Alternatively, a portion of a ring such as a U shaped portion may be applied. The maximum dimensions of the PCB 3 are determined by the differential between the selected diameters of the outer conductor sleeve 7 section(s) and the outer wall 15. The PCB chamber 5 is also dimensioned longitudinally to accommodate the expected height of any PCB 3 mounted electrical components such as inductors, capacitors and or metal oxide varistors. In alternative embodiments, a PCB 3 may be applied at both ends of the PCB chamber 5 and or the desired electrical components may be mounted to both sides of a PCB 3.

Figure 5:
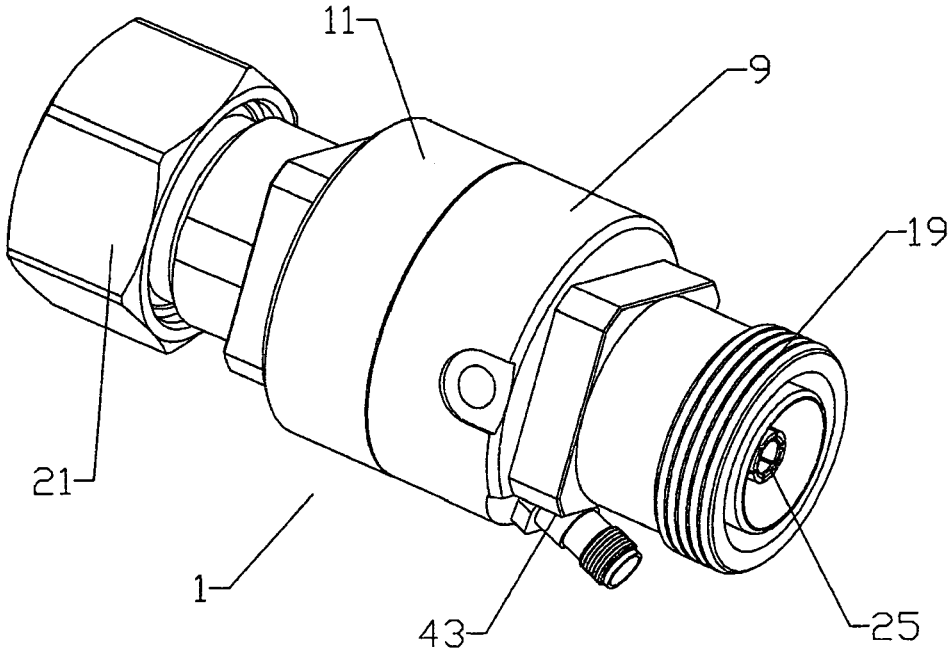
FIG. 5 is a schematic isometric external view of an alternative embodiment of the invention.
Figure 6:
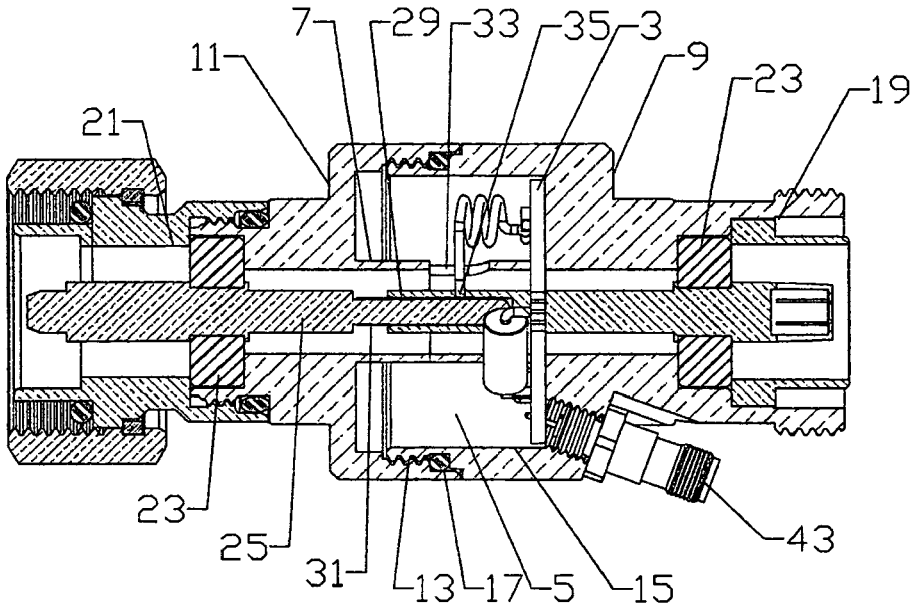
FIG. 6 is a schematic side cross-section view of the assembly of FIG. 5.

First and second electrical connection interface(s) 19, 21 at corresponding ends of the first and second portion(s) 9, 11 may be selected from standardized and or proprietary configurations according to the expected interface requirements of the assembly 1. For example, FIGS. 1–4 demonstrate first and second connection interface(s) formed as male and female Type N connectors while FIGS. 5 and 6 show a 7/16 DIN connector interface. Alternatively, any desired connector interface with selected male and or female configuration may be applied, including first and second connection interface(s) 19, 21 adapted to accept raw cable ends.

One skilled in the art will appreciate that the ring shaped PCB chamber 5 and perpendicular (normal) orientation of the PCB 3 therein allows a majority of the first and second portion 9, 11 features to be cast and or machined along a single central turning axis, greatly simplifying the machine tool equipment requirements and number of tool station mounting operations that are required during manufacture. Further, the separate cover, environmental seal and cover retaining hardware found in prior off-axis rectangular PCB chamber configurations has been eliminated.

TABLE OF PARTS

| | |
|---|---|
| 1 | assembly |
| 3 | printed circuit board |
| 5 | PCB chamber |
| 7 | outer conductor sleeve |
| 9 | first portion |
| 11 | second portion |
| 13 | thread |
| 15 | outer wall |
| 17 | o-ring |
| 19 | first connection interface |
| 21 | second connection interface |
| 23 | insulator |
| 25 | inner conductor |
| 27 | pin |
| 29 | spring finger |
| 31 | dielectric sleeve |
| 33 | slot |
| 35 | hole |
| 37 | contact surface |
| 39 | connection hole |
| 41 | screw |
| 43 | port |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An in-line coaxial circuit assembly, comprising:

a first portion which couples to a second portion;

the coupling of the first portion and the second portion forming an enclosed cylindrical PCB chamber, the PCB chamber coaxial with a longitudinal axis of the assembly;

an inner conductor extending between the first portion and the second portion, positioned along the longitudinal axis, electrically isolated from the first portion and the second portion;

a cylindrical outer conductor sleeve formed in at least one of the first portion and the second portion: the outer conductor sleeve(s) coaxial with the inner conductor, generally isolating the PCB chamber from the inner conductor; and a PCB in the PCB chamber, the PCB oriented perpendicular to the longitudinal axis of the assembly.

2. An in-line coaxial circuit assembly, comprising:

a first portion having a first electrical connector interface on a first end;

a second portion having a second electrical connector interface on a second end;

the first portion and a second portion adapted to couple together along an outer wall of at least one of the first portion and the second portion;

a cylindrical outer conductor sleeve coaxial with the outer wall formed in at least one of the first portion and the second portion; the coupling of the first portion and the second portion operating to form a generally enclosed cylindrical PCB chamber between the outer conductor sleeve and the outer wall; and a PCB positioned within the PCB chamber.

3. The assembly of claim 2, further including an inner conductor positioned coaxial within the outer conductor sleeve extending between the first electrical connector interface and the second electrical connector interface.

4. The assembly of claim 3, wherein the inner conductor has an in-line dielectric spacer.

5. The assembly of claim 4, wherein the dielectric spacer is a dielectric sleeve positioned between a pin of the inner conductor and one or more spring finger(s) of the inner conductor.

6. An in-line coaxial circuit assembly, comprising:

a first portion having a first electrical connector interface on a first end;

a second portion having a second electrical connector interface on a second end;

the first portion and the second portion adapted to couple together along an outer wall of at least one of the first portion and the second portion;

a cylindrical outer conductor sleeve coaxial with the outer wall; the coupling of the first portion and the second portion operating to form a generally enclosed cylindrical PCB chamber between the outer conductor sleeve and the outer wall;

an inner conductor positioned coaxial within the outer conductor section extending between the first electrical connector interface and the second electrical connector interface; and a PCB positioned within the PCB chamber, the PCB coupled to the inner conductor through a slot in the outer conductor sleeve.

7. The assembly of claim 6, further including a dielectric spacer between a first end and a second end of the inner conductor.

8. The assembly of claim 6, further including at least one port in one of the first portion and the second portion.

9. The assembly of claim 6, wherein the PCB is ring shaped.

10. The assembly of claim 6, wherein the PCB has a DC bias and surge suppression circuit.

11. The assembly of claim 6, wherein the PCB is coupled to the inner conductor via an inductor.

12. The assembly of claim 11, wherein one end of the inductor is coupled to the inner conductor by a butt solder joint.

13. The assembly of claim 6, wherein the first portion and the second portion coupling is via overlapping portions of the outer wall formed in the first portion and the second portion.

14. The assembly of claim 13, further including threads formed in the overlapping portions of the outer wall.

15. A method for manufacturing an in-line coaxial circuit assembly, comprising the steps of:

forming a first portion having a first electrical connector interface on a first end;

forming a second portion having a second electrical connector interface on a second end;

at least one of the first portion and the second portion having a cylindrical outer conductor sleeve coaxial with an outer wall of at least one of the first portion and the second portion;

positioning an inner conductor coaxial within the outer conductor sleeve, the inner conductor extending between the first electrical connector interface and the second electrical connector interface;

inserting a PCB into a PCB chamber between the outer wall and the outer conductor section;

coupling the PCB to the inner conductor through a slot in the outer conductor section; and coupling the first portion and the second portion together along the outer wall;

the coupling of the first portion and the second portion generally enclosing the cylindrical PCB chamber between the outer conductor sleeve and the outer wall.

16. The method of claim 15, wherein the inner conductor is formed in two portions separated by a dielectric spacer.

17. The method of claim 15, further including the step of adding at least one output to one of the first portion and the second portion, the output coupled to the PCB.

* * * * *